United States Patent [19]

Buzzi

[11] Patent Number: 4,693,194

[45] Date of Patent: Sep. 15, 1987

[54] MECHANISM FOR ACTUATING THE HOOK AND CLAW AND FOR STITCH SETTING IN PORTABLE SEWING MACHINE

[75] Inventor: Riccardo Buzzi, Milan, Italy

[73] Assignee: Matalplast S.r.l., Italy

[21] Appl. No.: 835,267

[22] Filed: Mar. 3, 1986

[30] Foreign Application Priority Data

Mar. 14, 1985 [IT] Italy ..... 19904 A/85

[51] Int. Cl.[4] ..... D05B 1/06; D05B 27/22

[52] U.S. Cl. ..... 112/199; 112/169; 112/315

[58] Field of Search ..... 112/199, 197, 200, 202, 112/169, 165, 166, 314, 315

[56] References Cited

U.S. PATENT DOCUMENTS 2,538,565 1/1951 Johnson ..... 112/315
2,720,853 10/1955 Artzt ..... 112/315
3,952,674 4/1976 Hirayama ..... 112/199
4,311,105 1/1982 Buzzi ..... 112/199
4,543,896 10/1985 DeSantis ..... 112/199 X

FOREIGN PATENT DOCUMENTS 1660963 2/1971 Fed. Rep. of Germany ..... 112/199
829852 11/1968 Italy .

*Primary Examiner*—H. Hampton Hunter
*Attorney, Agent, or Firm*—Kirschstein, Kirschstein, Ottinger & Israel

[57] ABSTRACT

In an actuating mechanism for the hook of portable sewing machines, a hook actuating profiled cam is provided which has a pin for simultaneously actuating the hook and the material transport feed dog through an interposed linkage having an adjustable element. By providing the hook formed with an eye, a double chain stitch seam can be effected. By further providing the cam with a depression for accommodating a foot of the hook therein during an oscillation of the foot, a greatly reduced overall size becomes achievable. Thanks to the adjustable element it also becomes possible to change the stitch length.

9 Claims, 33 Drawing Figures

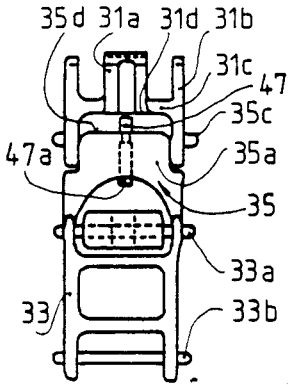
FIG. 17
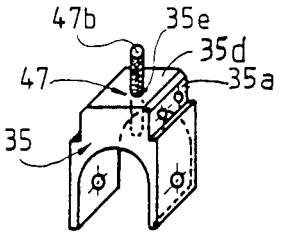
FIG. 18
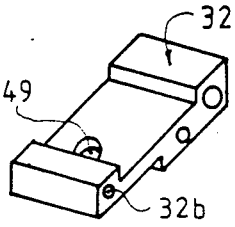
FIG. 19
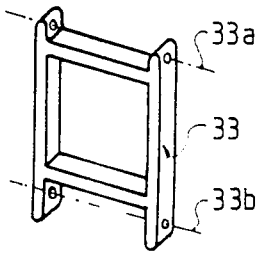
FIG. 20
FIG. 21
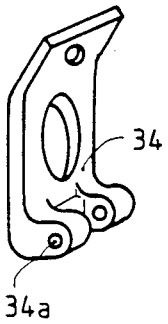
FIG. 22
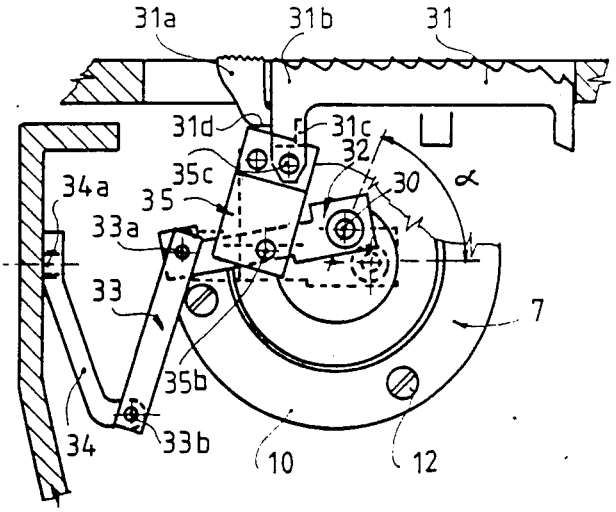

MECHANISM FOR ACTUATING THE HOOK AND CLAW AND FOR STITCH SETTING IN PORTABLE SEWING MACHINE

BACKGROUND OF THE INVENTION

1. Field of the Invention

This invention relates to a mechanism for actuating the hook and feed dog and for adjusting the stitch length in portable sewing machines.

2. Description of Related Art

Portable sewing machines are employed to sew closed with chain stitch seams packages, sheets, and paper or canvas bags e.g. for packaging potatoes, granulated fodder, and so forth. Such machines are subjected, accordingly, to serve operating environments brought about, among other factors, by the nature of the materials handled, a dusty environment, the high sewing speeds sought, and so forth. These machines, moreover, are required to be reliable in operation and as light in weight as feasible.

With prior machines, chain stitching is of the plain type, that is, the chain is formed by a sequence of individual loops which are intertwined progressively one after another, the chain being formed by means of a needle having an associated hook set to swing reciprocatingly around the needle over an angle of about 150°-160°. A wider angle of rotary reciprocation of the hook is not presently achievable owing to structural limitations inherent in prior art designs. The hook is driven by a driveshaft by a cam, the latter having two spaced-apart detents cooperating with two detents, also spaced apart, which are rigid with a hook carrier shaft.

Such a construction is disclosed in Italian Pat. No. 829,852. Prior machines further include a mechanism for actuating the feed dog for advancing the material being sewn. Such mechanisms require a large number of components, and accordingly, are bulky and heavy. This results in increased overall dimensions of the sewing machine, and attendant heavier weight thereof. Prior sewing machines are also provided with a mechanism made up of several parts for setting the sewing stitches to different lengths. This brings about, in turn, similar problems to the above. With prior machines, the large number of moving parts also pose wear problems and tolerance problems. The net result is noisy operation and the need for frequent lubrication. In practice, moreover, it has been found that accidental breakage of some plain chain stitches can often result in running of the adjacent stitches and consequently in the bag or the like being opened and its contents, e.g. granulated fodder, lost. This is specially likely to also occur while handling, shifting, or shipping such bags and the like, as well as on account of faulty seams.

SUMMARY OF THE INVENTION

This invention provides a mechanism for actuating the hook and feed dog, and for setting the stitch length, which is simplified and affords an increased angle of rotary hook reciprocation, the proposed mechanism also affording double chain stitching capability and variability of the stitch length to suit the material being sewn or its contents, from outside the machine.

With the above aim, the proposed mechanism has a reduced number of parts, and therefore, a reduced overall size and weight.

The proposed mechanism should also afford high sewing speed capability, be highly reliable in operation even in heavy-duty applications, and make the usual lubrication practically unnecessary.

The sewing machine comprises, for hook actuation, a profiled cam cut with two oscillation detents, the cam being oscillated by a machine driveshaft and carried in a cup-like cam casing attached to a machine casing. The cam cooperates with two counterdetents rigid with a hook shaft, which is supported obliquely on said cup-like casing. The aim of this invention is achieved by that:

i. the profiled cam for the hook oscillatory movement also has a feed dog driving pin operating through a linkage, an element of said linkage being arranged to have a variable length to thereby vary the stitch length;

ii. the two counter-detents for the hook oscillation are formed by the ends of a foot of the hook carrier shaft, and the two cam oscillation detents consist of two sectional cross sides thereof, between which cross sides, and adjacently thereto, said cam is recessed to enable formation of said detents and free oscillation, within the cam, of said foot of the hook during the hook oscillatory movement;

iii. the hook has on its base portion a curled up strip or coil-like configuration extending over about a full turn, the free end of the hook being formed with a yarn eye to form a double chain stitch;

iv. a yarn feeding means for a double chain loop on the hook and a means for guiding the yarn into the double chain loop are also provided; and v. the cup-like casing accommodating the cam has juts for its mated mounting in the sewing machine casing.

According to the invention, the cam is diskshaped and the cam casing has a cylindrical chamber accommodating said cam.

Further according to the invention, the yarn guiding means consists of an elongated groove one end of which starts from a junction at the hook base, and extends to an opening at a location close to the eye in the hook.

The yarn feeding means for the double chain loop consists, according to the invention, of a guide tube on the exterior of the sewing machine casing which opens to a location close to the hook, some segments of said tube, facing outwards from the sewing machine, being removed for better convenience in setting the yarn.

According to the invention, moreover, the juts for a matching fit of the cam casing into the sewing machine casing have an annular shape.

A drive pin for driving the feed dog advantageously, according to the invention, is received in a seating hole in the cam. The latter also has, on a front side thereof, a closure ring fitting with a slight clearance in a bottom wall of said cam casing.

According to the invention teachings, the advantage is thus afforded of a single mechanism driving in common the hook and feed dog, which mechanism is advantageously formed of a small number of easily and quickly assembled parts, and enables the stitch length to be varied from its maximum value of about 11 mm to its minimum value of about 3 mm. The stitch length can be advantageously set from the machine exterior. That assembly, moreover, requires no complicated initial adjustment operations. Weight can be quite low and the overall size small. Operation is made advantageously highly reliable even at high sewing speeds. The latter may also be attained on account of the wider angle of rotary reciprocation of the hook now attainable with the proposed structure. Another advantage of the proposed mechanism is that a double chain stitch seam can be formed only with a single hook. Given the small number of the parts and their association, wear rate is also low and the traditional lubrication at frequent intervals made unnecessary. The net result is, therefore, a sewing machine which is lightweight, reliable and safe to operate even at high speeds and in severe operating conditions. Reliable operation is ensured in that a positive form of yarn pick up by the hook is provided regardless of the yarn position, since the hook tip, which can be rotated at a very small distance from the needle axis, e.g. on the order of about 0.2 mm, affords a very short path of movement around the needle. Sewing machines according to the invention may thus be as light as about 1.9 kg versus about 5 kg for comparable prior sewing machines.

BRIEF DESCRIPTION OF THE DRAWINGS

Further features, advantages, and details of the mechanism for actuating the hook and feed dog in portable sewing machines for double chain stitch sewing according to the invention will become apparent from the following description, given herein by way of example and not of limitation with reference to the accompanying drawings, which show diagramatically and to different scales, in FIG. 1 a side elevation view of a sewing machine with the mechanism of this invention depicted in dashed lines;

in FIG. 17, a view of the linkage taken in the direction of the arrow F in FIG. 16;

in FIGS. 18, 19, 20 and 21, perspective views of linkage of FIG. 17, namely, the block, connecting rod, linkage bracket, and stationary holder for the same, respectively;

in FIG. 22 a detail view analogous to FIG. 16 during operation; and in FIGS. 23 and 24 greatly enlarged perspective views of a plain chain stitch and double chain stitch seam, respectively.

DESCRIPTION OF THE INVENTION

Figure 9:
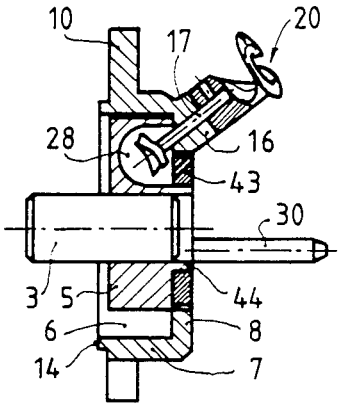
in FIG. 9 a vertical mid-sectional view taken through the actuating cam according to the invention in its cup-like casing supporting the hook.
Figure 10:
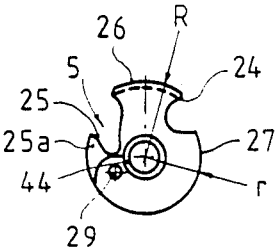
in FIGS. 10, 11, 12*a* and 12*b*, views of the actuating cam, namely a front view of the front side opposing the bottom of the cup-like casing, a rear view of the opposite side, a view from above, and front and rear perspective views, respectively.
Figure 11:
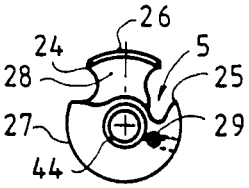
Figure 12:
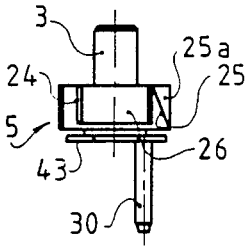
Figure 8A:
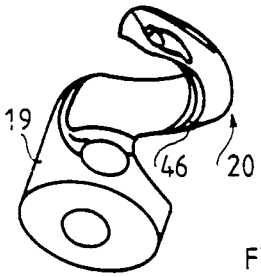
Figure 8B:
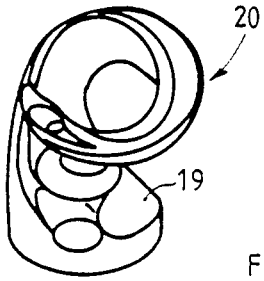
Figure 8C:
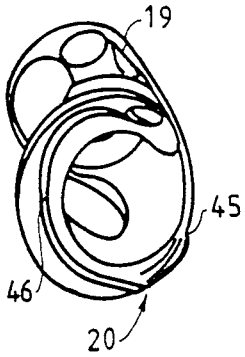
Figure 12A:
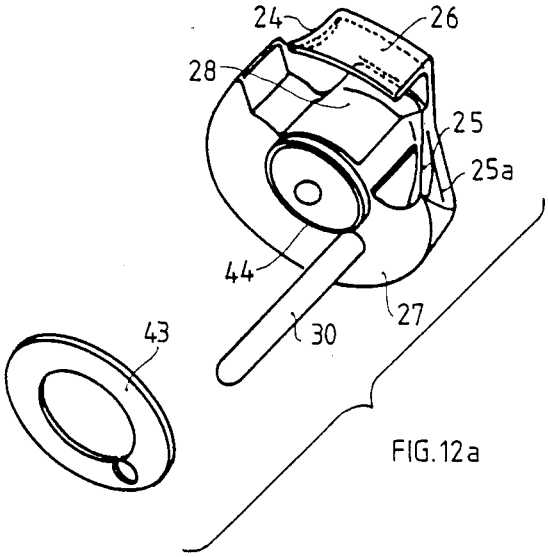
Figure 12B:
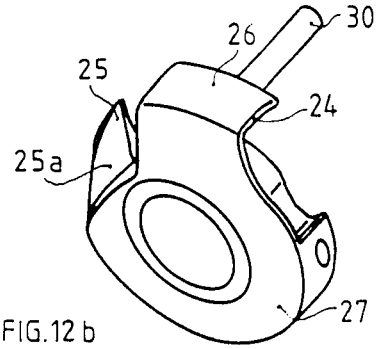
Figure 23:
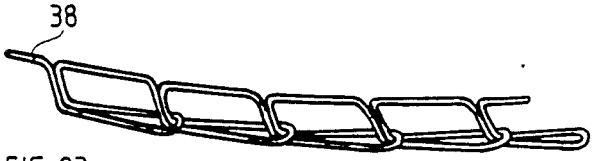
Figure 13:
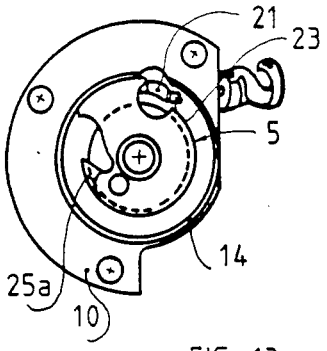
in FIGS. 13 and 14, respectively a view of the actuating cam in its casing, and specifically in the two end-limiting striking positions of the cam and hook foot marking the starts of two respective rotary reciprocations of the hook.
Figure 14:
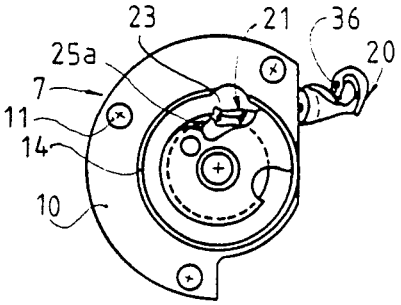
Figure 15:
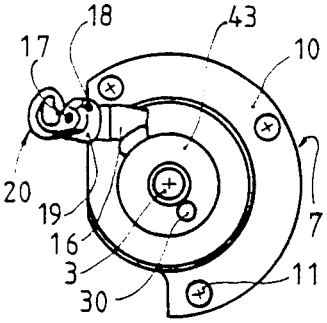
in FIGS. 15 and 15*a* views the outer side of the cam casing with the feed dog drive parts removed for clarity at both end-limiting portions.
Figure 15A:
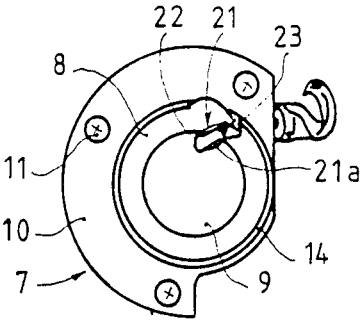
Figure 16:
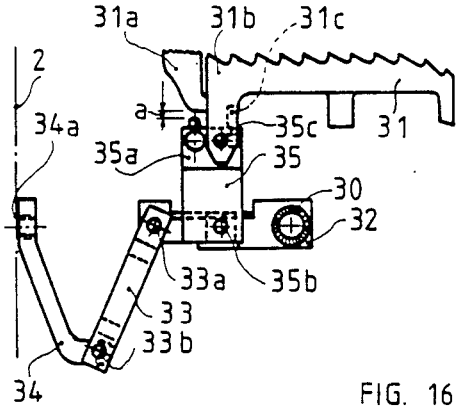
in FIG. 16 a side elevation view of the actuating linkage for the feed dog and for changing the stitch length.

Indicated at 1 is a sewing machine incorporating the driving mechanism of this invention. The machine has a casing 2 accommodating a non-illustrated drive motor and power transmission of conventional design. The output shaft of the transmission is indicated at 3. The shaft 3 enters walls 4*b* of shrouding chamber 4 housing the proposed drive mechanism. The mechanism comprises a profiled disk-like cam 5 (see FIGS. 9–12, 12*a*, 12*b*, 12*c* keyed to the drive shaft 3 and being accommodated in a seat 6 provided in a cup-like cam casing 7 supporting said cam 5. The casing 7 has a casing bottom 8 apertured in the middle at central aperture 9, and a flange 10 apertured as at holes 11 (see FIG. 15) to let through screws 12 (FIGS. 3, 4) for fastening the cam casing 7 to the partition wall 4*b* of the chamber 4. Indicated at 14 is a ring collar of the casing 7 for geometrical engagement in a corresponding seat in said wall 4*b*. The casing 7 also has removed portions, as may be seen from the figures, for minimizing its overall size. Also provided on the casing 7 is a bored projection 16 (FIGS. 9, 15) for supporting a pin 17 carrying on one end, by means of a dowel 18, the base 19 of a coiled strip-like, hook 20, and on the opposite end, a profiled foot 21 (FIGS. 9, 13, 14). The shapes of the hook 20 and the foot 21 may be seen from FIGS. 8*a*, 8*b*, 8*c* and FIGS. 15, 15*a*. Indicated at 22 and 23 are the counter-detents or abutment surfaces for the foot 21, which during rotation of the cam 5 cooperate, to start a reciprocating oscillation of the foot 21 and the hook 20 about the axis of pin 17, with detents or abutments 24, 25, respectively, in the form of transverse edges on the cam 5 (see FIGS. 12*a*, 12*b*). As may be seen from FIG. 10, the cam 5 is composed substantially of a first segment 26 and a second segment 27, the segments having curvature radii R and r which differ from each other as explained hereinafter. The cam 5 has in the segment 26, on the side facing the bottom 8 of the casing 7, a profile cut depression 28, as may be seen from FIGS. 9, 11, 12*b* to allow the foot 21 to oscillate freely therein during cam rotation. Thus, a greatly reduced overall size for the cam and the hook is attained. According to the invention, in the cam 5 there is also provided a seat 29 for accommodating a drive pin 30 for driving a feed dog 31 through a linkage (FIGS. 4*a*, 4*b*, 4*c*) comprising a connecting rod 32 accommodating the drive pin 30; a connecting link 33 hingedly connected on one end at 33*a* (FIG. 16) to the connecting rod 32, and on the other end at 33*b* to a stationary inclined support 34 attached at screw 34*a* to the machine casing 2, and a block 35 for setting the stitch length. The block 35 is hinged at the bottom at 35*b* to the connecting rod 32 and has at the top a head 35*a* to which there are hinged at 35*c* upper arms 31*b* (FIG. 17) of the feed dog 31, the arms 31*b* being radiused together by a cross web 31*c*. The feed dog 31 has a middle head 31*a* having a bottom side 31*d* positionable at a maximum oscillation distance a (FIG. 16) from the top side 35*b* of the head 35*a*. An oscillation setting screw 47 having a head 47*a* and abutment end 47*b* is threadedly mounted for adjustable movement inside threaded hole 35*e* formed in head 35*a*. By increasing the oscillation of the articulated block 35, the shorter will be the stroke of the feed dog 31 and therefore the shorter the length of the stitches.

Figure 2:
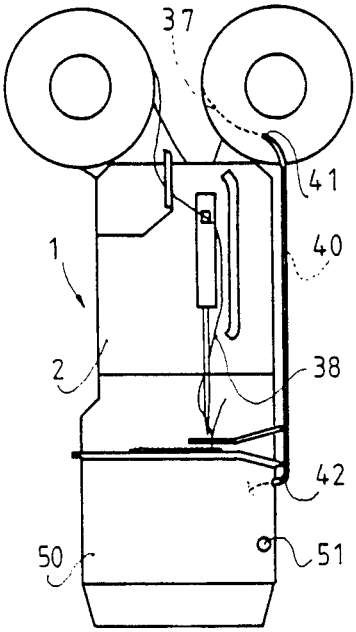
in FIG. 2 a front view of the sewing needle side of the machine.

The maximum distance a is attained by loosening the screw 47 until its abutment end 47*b* reaches below the top side 35*b* of the block head 35*a* (see FIG. 22). With the abutment end 47*b* in abutment with the bottom side 31*d* of the head 31*a* (see FIGS. 4*a*, 4*b*, 4*c*), the cross web 31*c* will abut against the head 35*a* and the block 35 and feed dog 31 form accordingly a rigid piece. In practice, the range of length variation of the stitches is from about 10–11 mm (rigid linkage condition of FIGS. 4*a*, 4*b*, 4*c*) to about 3 mm (free linkage condition of FIG. 22). To reach the screw 47 with a screwdriver, a hole 48 is provided in the bottom 4*a* of the chamber 4 and a hole 49 (see FIG. 19) is provided through the connecting rod 32. Indicated at 50 in FIG. 2 is a closure cover hinged at 51.

Figure 1:
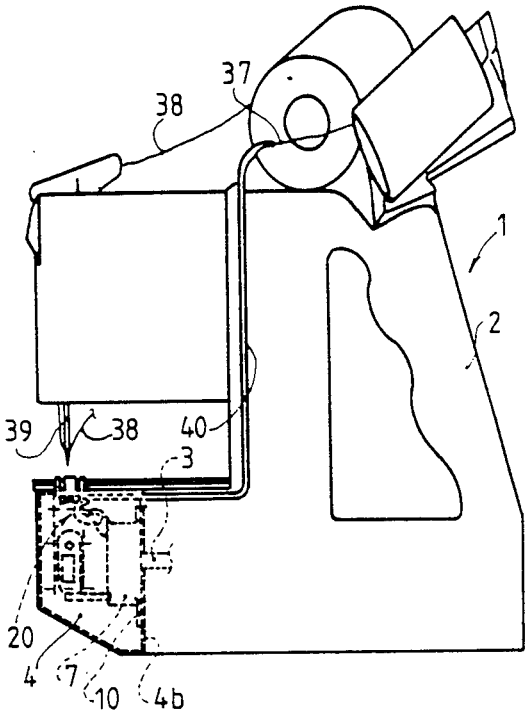
Figure 3:
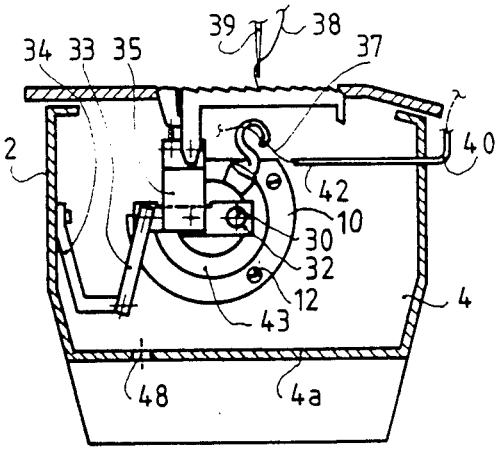
in FIGS. 3, 4, 4*a*, 4*b* and 4*c* front views, as seen from the needle side, of the mechanism, with the closure cover removed and at different rotational positions of the actuating cam.
Figure 24:
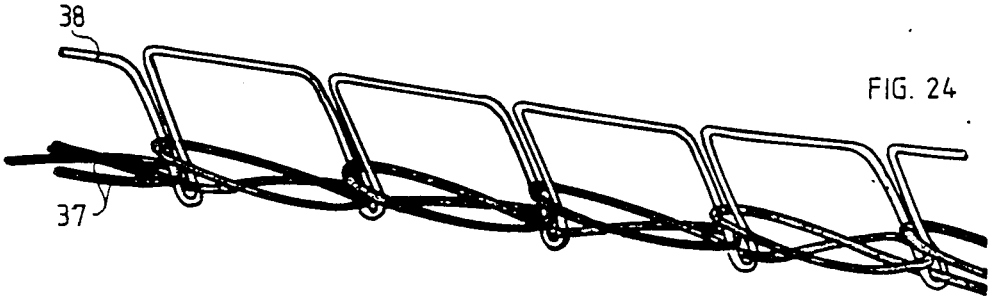

Reverting in particular to FIGS. 6, 9, 14 and 15, it can be further seen that the hook 20 has an open coil or curled strip-like configuration with an eye 36 close to its end for conducting a double chain stitch yarn 37 shown in FIG. 24, whereas at 38 there is indicated the traditional plain chain stitch yarn led by the needle 39, with which the hook 20 is arranged to cooperate in a manner known per se. Indicated at 40 in FIGS. 1–3 is a yarn guide means 37 which comprises a small tube 40 outside the casing 2. Tubular guide 40 has a yarn inlet end 41 and a bent end 42 extending inside the chamber 4 and being terminated close to the hook 20. For convenience of introduction of the yarn 37, the tube 40 has removed skirt portions along its length, not shown in the drawing. Indicated at 43 in FIGS. 12*a* and 9 is a washer keyed to an annular seat 44 of the cam 5 to cover the central aperture 9. Provided on the hook 20 is a means for guiding the double chain stitch yarn 37 consisting of a peripheral shouler 45 (see FIG. 8*c*) starting at one end from the junction of the hook 20 to the base 19 thereof, said shoulder extending then to form a groove 46 over the lower portion of the hook which opens close to the eye 36 thereof.

Figure 4:
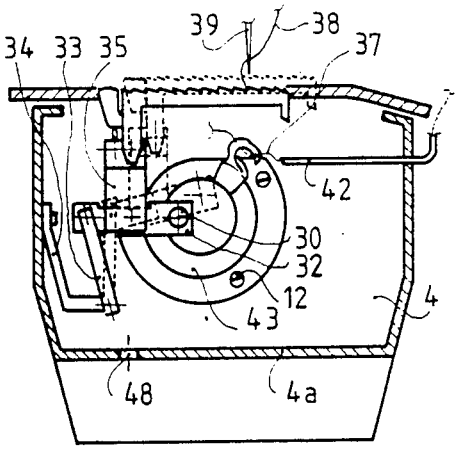
Figure 4A:
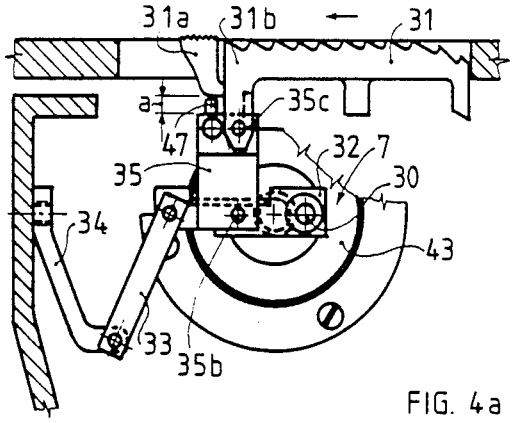
Figure 4B:
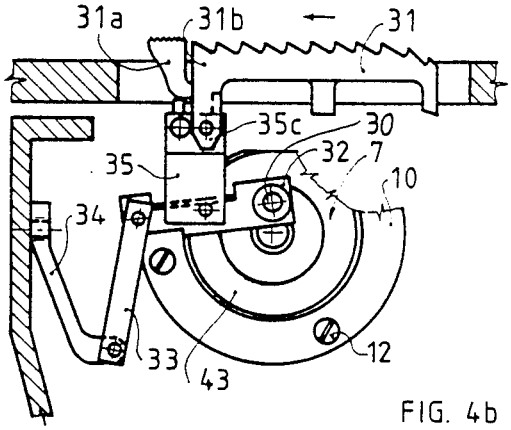
Figure 4C:
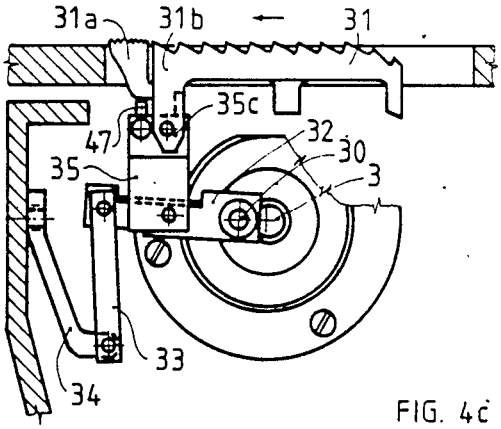
Figure 5:
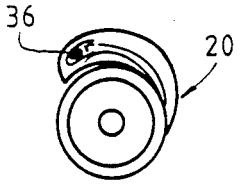
in FIGS. 5, 6, 7, 8, 8*c*, 8*b* and 8*c* various views of the hook of this invention, namely a view from below, a view from above, two side elevation views from opposite sides thereof and three perspective views, respectively.
Figure 6:
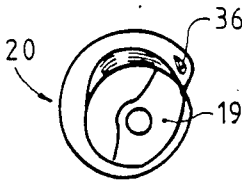
Figure 7:
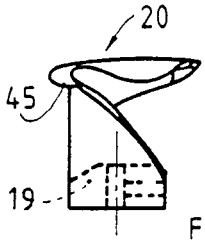
Figure 8:
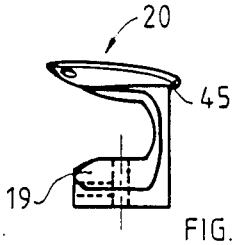

The operation of the proposed mechanism with which the hook and feed dog can be advantageously simultaneously actuated, the double chain stitch length can be varied, and the hook can complete an angle of rotary reciprocation as large as 180°, will be now described briefly. Starting from the position shown in FIGS. 13 and 15*a* whereat the detent 24 of the cam 5 strikes the counter-detent 22 of the foot 21, on rotating the cam 5 this will bring about a first rotary oscillation of the foot 21 about the hook pin 17 through 180° in one direction, the offcentered positioning of the foot 21 from the axis of its carrier pin 17 favoring said rotational movement by gravity force. During this rotation, the foot 21 moves in the cited depression 28 (FIG. 9). On completion of this first 180° turn in one direction, the foot 21 will occupy the position shown in FIG. 14, whereat the detent 25 of the cam 5 is striking the other counter-detent 23 of said foot 21. As the rotation of the cam 5 is continued, there will first occur a 180° turn of the foot 21 in the opposite direction to the former, that rotation being brought about by the cam profile 25*a*. This is followed by a sliding engagement of an arcuate surface 21*a* of the foot 21 on the outside surface of the segment 27 of radius r, which for this reason is made smaller than the radius R of the segment 26, said segment 27 extending advantageously over about 225°. This engagement is then ensured mechanically, that is by positive mechanical sliding engagement, and during it there occurs a phase of hook stopping i.e. the hook cannot rotate. Thus, we are back to the position of FIG. 13. During this rotation, there has also simultaneously occurred a command to move the feed dog 31 forward by means of the drive pin 30 and of the cited linkage, as previously adjusted by the setting screw 47 as specified above. Shown in phantom lines in FIG. 4 is the the lifted position of the claw 31. The intermediate phases are illustrated in FIGS. 4*a*, 4*b*, 4*c* for the aforementioned rigid linkage condition.

FIG. 22 shows the maximum angular position of block 35 (which serves as a lower leg for the feed dog) relative to the arms 31*b* (which serve as an upper leg for the feed dog). The screw 47 is backed off to its fullest extent. The angular movement of block 35 occurs while the driving pin 30 moves through arc $\alpha$. The smaller the clearance a, the smaller the arc $\alpha$, and the shorter the stroke of the feed dog.

It may be appreciated from the foregoing that the mechanism of this invention fully achieves the aim set forth for it and that the advantages mentioned in the preamble are afforded. With a single mechanism, comprising a limited number of components, it is now possible, therefore, to simultaneously actuate the hook and feed dog of portable sewing machines allowing, through the application of an eye 36 to the hook 20, insertion into the plain chain stitch 38 of a yarn 37 to produce a double chain stitch. This may be accomplished by the kinematic and structural expedients according to the invention, which also enable adjustment of the stitch length within a broad range and the achievement of a 180° angle of rotary reciprocation for the hook.

The net result is a mechanism which has greatly reduced space requirements and a very low weight. A sewing machine of the type indicated and incorporating the mechanism of this invention can have a lighter weight than 1.9 kg. For further advantages to be obtained hereby, reference can be had to what has been put forth in the preamble.

In practice, the proposed mechanism can have its parts modified in any way by a skilled person, without departing from the spirit of the invention.

All the features to be inferred from the description, claims, and drawings are regarded as being substantial to this invention, either singly or in any desired combination thereof.

I claim:

1. In a machine for sewing a double chain stitch in a material, an arrangement comprising:

(a) a sewing needle elongated and reciprocatable along a longitudinal axis, said needle having a needle eye;

(b) means for feeding a first thread through the needle eye;

(c) a movable feed dog for feeding the material to be sewn underneath the needle;

(d) a single turnable hook member having a stem elongated along a hook axis which is inclined relative to the longitudinal axis, and an arcuate hook extending circumferentially at least partly about the longitudinal axis and having a hook eye, said hook member being mounted for turning movement in alternate circumferential directions about the inclined hook axis;

(e) means for feeding a second thread through the hook eye; and (f) means for making a double chain stitch in the material, including a common drive for repetitively moving the feed dog along successive advancement strokes to successively advance the material to be sewn past the reciprocatable needle and the hook member, and for simultaneously and repetitively turning the hook member along said alternate circumferential directions to intertwine the first and second threads into the double chain stitch.

2. The arrangement as recited in claim 1, wherein the common drive includes a rotatable cam mounted for rotation about a cam axis, said cam having a pair of cam abutment portions spaced radially and circumferentially apart of each other relative to the cam axis, and wherein the hook member has a foot on the stem, said foot having a pair of foot abutment portions each engageable and driven by a respective cam abutment portion during cam rotation.

3. The arrangement as recited in claim 1, wherein the common drive includes a cup-shaped cam casing in which the cam is mounted, said cam casing having an elongated tubular support extending along the inclined hook axis, said stem being turnably mounted within the tubular support.

4. The arrangement as recited in claim 1, wherein the common drive includes a drive pin mounted on the cam for joint rotation therewith and extending along a drive axis parallel to, and offset from, the cam axis; and wherein the common drive includes a kinematic linkage operatively connected among the drive pin, the feed dog and a stationary casing for the machine.

5. The arrangement as recited in claim 4, wherein the linkage includes a plurality of articulated links and an adjustable element mounted on one of the links for adjusting movement for adjusting the length of each advancement stroke and, in turn, the length of each stitch of the double chain stitch.

6. The arrangement as recited in claim 5, wherein the feed dog has a head and a depending leg jointly movable with the feed dog, said one link being a control link pivotably connected to the leg for pivoting movement about a pivot axis, said adjustable element being movable from a rigid condition in which the adjustable element abuts the head and prevents said pivoting movement of the control link, to a free condition in which the adjustable element is spaced by a predetermined spacing from the head and permits said pivoting movement, the magnitude of said spacing controlling the extent of said pivoting movement.

7. The arrangement as recited in claim 6, wherein another of the links is a first connecting link, one end of which carries the drive pin, and having another end, and wherein the control link is pivotably connected to an intermediate part of the first connecting link; and further comprising a second connecting link having opposite ends, one of which is connected to the other end of the first connecting link; and also comprising an inclined support link having one end stationarily mounted to the machine casing and an opposite end connected to the opposite end of the second connecting link.

8. The arrangement as recited in claim 5, wherein the adjustable element has a drive end which is accessible from outside the machine.

9. In a sewing machine, an arrangement comprising:

(a) a sewing needle elongated and reciprocatable along a longitudinal axis, said needle having a needle eye;

(b) means for feeding a first thread through the needle eye;

(c) a movable feed dog for feeding material to be sewn underneath the needle, said feed dog having a head and a depending leg jointly movable with the feed dog;

(d) a turnable hook member having a stem elongated along a hook axis which is inclined relative to the longitudinal axis, and an arcuate hook extending circumferentially at least partly about the longitudinal axis and having a hook eye, said hook member being mounted for turning movement in alternate circumferential directions about the inclined hook axis;

(e) means for feeding a second thread through the hook eye; and (f) a common drive means for repetitively moving the feed dog along successive advancement strokes to successively advance the material to be sewn past the reciprocatable needle and the hook member, and for simultaneously and repetitively turning the hook member along said alternate circumferential directions to intertwine the first and second threads into a chain stitch, said common drive including (i) a rotatable cam mounted for rotation about a cam axis, (ii) a drive pin mounted on the cam for joint rotation therewith and extending along a drive axis parallel to, and offset from, the cam axis, and (iii) a kinematic linkage operatively connected among the drive pin, the feed dog and a stationary casing for the sewing machine, said linkage including a plurality of articulated links, and an adjustable element mounted on one of the links for adjusting movement to adjust the length of each advancement stroke and, in turn, the length of each stitch of the chain stitch, said one link being a control link pivotably connected to the leg of the feed dog for pivoting movement about a pivoted axis, said adjustable element being movable from a rigid condition in which the adjustable element abuts the head and prevents said pivoting movement of the control link, to a free condition in which the adjustable element is spaced by a predetermined spacing from the head and permits said pivoting movement, the magnitude of said spacing controlling the extent of said pivoting movement.

* * * * *